United States Patent [19]

Eanes

[11] Patent Number: 4,579,093

[45] Date of Patent: Apr. 1, 1986

[54] FUEL INJECTION, TWO CYCLE ENGINE

[75] Inventor: Swanson L. Eanes, Salem, Va.

[73] Assignee: American Fits Engine Company, Limited, Roanoke, Va.

[21] Appl. No.: 617,867

[22] Filed: Jun. 6, 1984

[51] Int. Cl.[4] ..... F01M 1/02; F02D 39/04

[52] U.S. Cl. ..... 123/65 BA; 123/41.35; 123/69 R; 123/196 CP

[58] Field of Search ..... 123/65 B, 65 BA, 65 P, 123/65 PD, 65 E, 69 R, 73 AD, 74 AE, 196 CP, 196 R, DIG. 7, 65 A, 73 C, 73 B, 41.35, 68; 184/6.8, 1.5, 6.2, 6.7

[56] References Cited

U.S. PATENT DOCUMENTS

| | | | |
|---|---|---|---|
| 976,858 | 11/1910 | Easthope | 123/74 AE |
| 1,097,725 | 5/1914 | McKiearnan | 123/65 BA |
| 1,119,102 | 12/1914 | Mitchell | 184/6.2 |
| 1,157,308 | 10/1915 | Hogan | 123/196 R |
| 1,281,644 | 10/1918 | Ostergren | 123/65 BA |
| 1,447,788 | 3/1923 | Kirkham | 184/6.2 |
| 1,612,372 | 12/1926 | Gussman | 184/6.8 |
| 1,779,077 | 10/1930 | Robey | 123/69 R |
| 1,867,682 | 7/1932 | Sperry | 123/69 R |
| 2,222,134 | 11/1940 | Augustine | 123/65 VD |
| 2,235,793 | 3/1941 | Berger | 184/6.2 |
| 2,246,019 | 6/1941 | Steinlein | 123/32 |
| 2,401,677 | 6/1946 | Yingling | 123/65 BA |
| 2,459,594 | 1/1949 | Smith | 123/196 W |
| 2,728,412 | 12/1955 | Bolsius et al. | 123/196 CP |
| 2,899,946 | 8/1959 | Lyvers | 123/65 B |
| 2,916,023 | 12/1959 | Sanborn | 123/257 |
| 2,983,334 | 5/1961 | Dalrymple | 123/196 CP |
| 3,190,271 | 6/1965 | Gudmundsen | 123/73 C |
| 4,068,629 | 1/1978 | Hooper | 123/65 S |
| 4,162,662 | 7/1979 | Melchior | 123/65 VD |
| 4,378,763 | 4/1983 | Ishihama | 123/196 R |
| 4,523,556 | 6/1985 | Suzuki | 123/196 R |

*Primary Examiner*—Magdalen Y. C. Moy
*Assistant Examiner*—David A. Okonsky
*Attorney, Agent, or Firm*—Fidelman, Wolffe & Waldron

[57] ABSTRACT

A two-cycle, spark ignition engine is improved in order to eliminate the need for the typical reed valves and carburetor, while eliminating the carbon build-up inherent in mixing of the lubricant with the fuel mixture. Fuel and air are injected into the combustion chamber, and oil is injected into the crankcase, while eliminating communication therebetween. The improvement may be provided as a retrofit kit, for the standard two cycle engine, or the original casting of the engine may include the required modifications.

5 Claims, 14 Drawing Figures

FUEL INJECTION, TWO CYCLE ENGINE

CROSS REFERENCES TO THE PRIOR ART

U.S. Pat. No. 2,899,946—Lyvers, TWO CYCLE GASOLINE ENGINE, issued Aug. 18, 1959.

U.S. Pat. No. 2,916,023-Sanborn, TWO-STROKE CYCLE ENGINE, issued Dec. 8, 1959.

BACKGROUND AND SUMMARY OF THE INVENTION

The invention relates to two-cycle, spark ignition engines, and particularly, to improvements thereof.

The typical two-cycle engine requires a mixture of oil and gasoline to be combined with air in the carburetor and supplied to the crankcase via a reed valve arrangement. On the compression stroke, such a mixture of fuel, air, and oil already in the combustion chamber is compressed, while the vacuum formed in the airtight crankcase by movement of the piston draws more of the mixture from the carburetor via the reed valves. At the top of the compression stroke, the pressure stabilizes in the crankcase to close the reed valves, the spark plug is fired, and the piston starts the return (power) stroke. During the return stroke, power is transmitted to the crankshaft and the mixture in the crankcase is compressed by the piston so that, near the bottom of the stroke, the piston uncovers the exhaust port and a fuel transfer port, allowing the pressurized mixture to rush into the combustion chamber and to force the burned gases out of the exhaust port.

Two-stroke engines are plagued by carbn build-up, which results from incomplete combustion of the oil and gasoline that are combined in the fuel tank. The carbon accumulates on the muffler and the exhaust ports and must be cleaned off regularly.

Accordingly, it is an object of this invention to provide a two-stroke engine in which the typical carbon build-up is eliminated by eliminating the need for mixing oil and fuel.

It is another object of this invention to provide for fuel injection to the combustion chamber of a two-stroke engine while lubricating the moving parts thereof via constant circulation and injection of oil into the crankcase thereof.

It is a further object of this invention to provide means for converting a standard two-stroke engine for fuel injection into the combustion chamber and oil injection into the crankcase, while blocking the transfer port to provide separation between the combustion chamber and crankcase.

It is a further object of this invention to provide a novel crankcase venting arrangement for relieving back pressure therein while preventing a loss of oil from an oil circulation system.

It is a further object of this invention to provide a continuously operating air blower attached to the cylinder via an air horn, with a butterly valve controlled by the spark advance mechanism such that air for the combustible mixture is varied in accordance with the requirements of the engine.

It is a further object of this invention to provide a fuel injection, two-cycle engine in which the fuel injection nozzle is protected from direct combustion of the engine.

These and other objects of the invention will become more readily apparent from the following disclosure.

In a preferred embodiment of the invention, a two-stroke engine is provided with oil injection to a crankcase integral with the cylinder wall of a combustion chamber, but separated from the chamber by a reciprocating piston. Fuel is injected into the combustion chamber of the cylinder in a timed relation in accordance with the load requirements of the engine. A continuously operating blower motor provides air to the combustion chamber, for the fuel and air combustible mixture, via a butterly valve attached to the spark advance linkage for proper variation thereof.

DETAILED DESCRIPTION OF THE INVENTION

Figure 1:
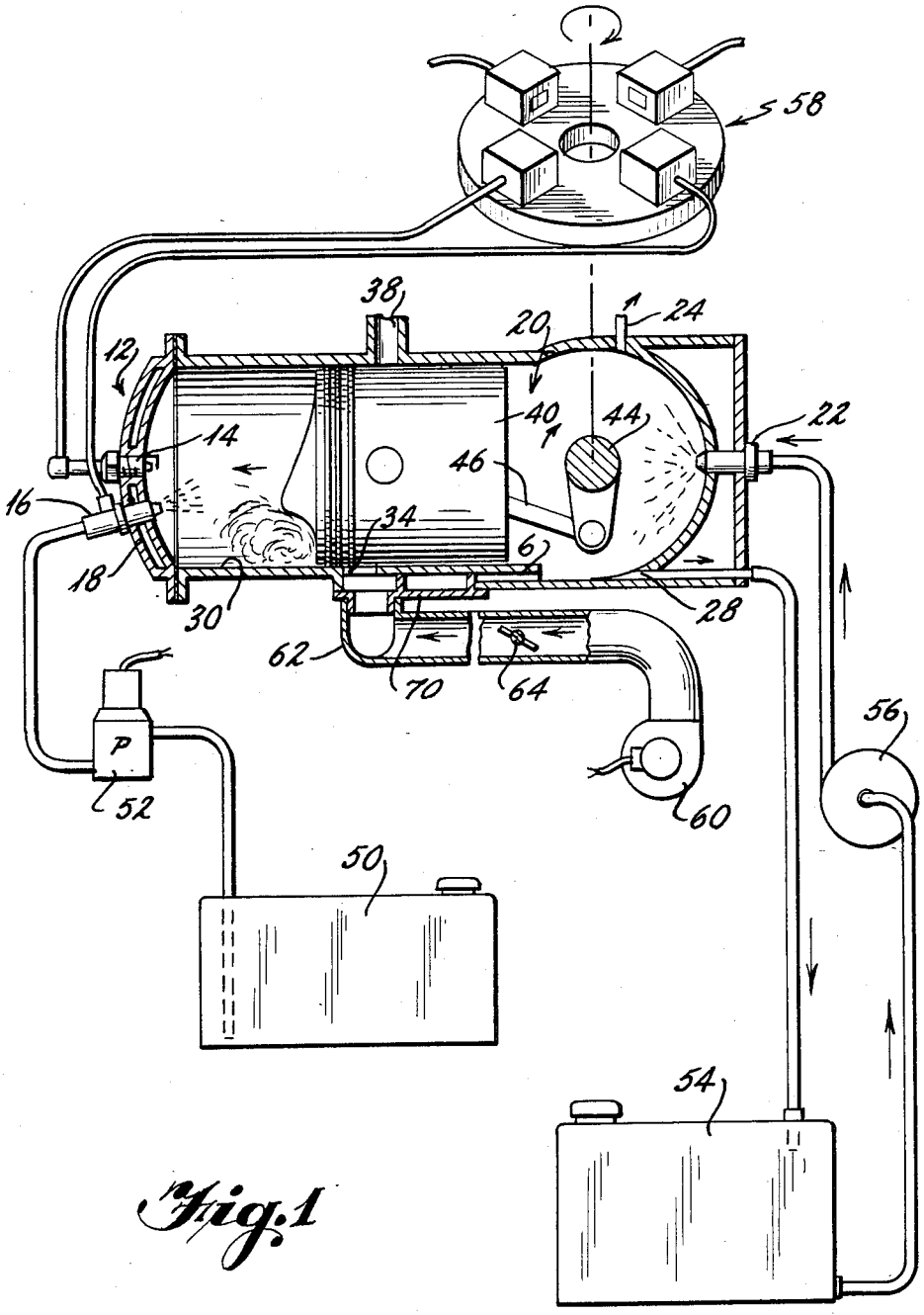
FIG. 1 is a plan view, partially in section, of one embodiment of the invention.
Figure 2:
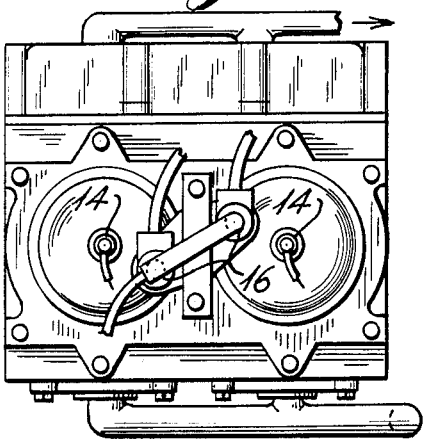
FIG. 2 is an end view depicting positioning of the fuel injector nozzles in the cylinder heads.
Figure 3:
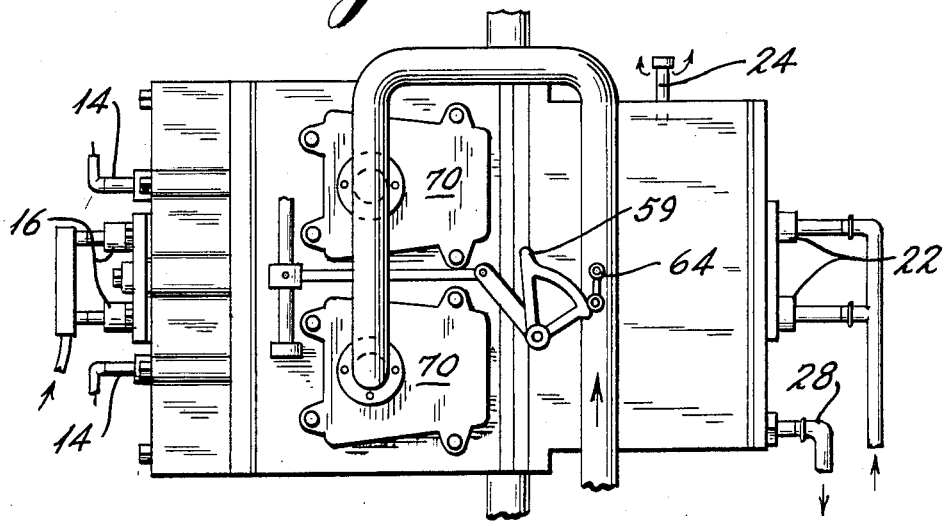
FIG. 3 is a bottom plan view of the device of FIG. 2.
Figure 4:
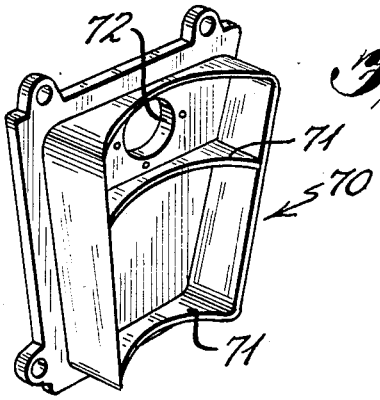
FIG. 4 is an isometric view of a special plate for blocking the transfer port of a standard two-cycle engine and for providing an air inlet to the intake ports thereof.

The cylinder of a standard two-stroke outboard engine, modified in accordance with the invention, is illustrated in cross-section in FIG. 1. In this embodiment, the typical reed valve and carburetor have been replaced by an oil injection nozzle 22, and the typical drain hole for excess volumes of the typical fuel and oil mixture has been enlarged to provide a return passage 28 for recirculation of the oil within the crankcase. The circulation path comprises oil return 28, oil reservoir 54, oil pump 56, and oil injection nozzle 22. The typical fuel transfer port 6 is blocked off by a special plate 70 which, as seen in FIG. 4, has redundant baffles 71 for blocking transfer port 6. Plate 70 is also provided with an air inlet fitting 72 by which pressurized air may be supplied to the typical intake port 34 from continuously operating blower motor 60 via air horn 62. A butterfly valve 64 is varied by linkage 59 (FIG. 3) in accordance with the standard spark advance and throttle mechanism.

Figure 5:
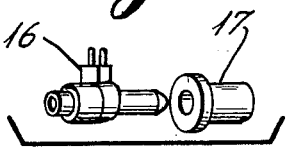
FIG. 5 is an isometric view of a fuel injection nozzle and special gasket used for connection of the nozzle through a water cooling jacket.

The head 12 of the cylinder has the typical spark plug 14 and is provided also with a fuel injection nozzle 16 opened and closed in a timed relation as needed. In FIG. 1, control of nozzle 16 is illustrated to be by an electronic timing mechanism 58 which may be used also for controlling the butterfly valve 64 and injection nozzle 16. Gasoline is supplied from reservoir 50 to nozzle 16, under pressure, by pump 52. As may be seen from FIG. 5, a special gasket 17 is provided with nozzle 16 in order to seal the water cooling jacket 18 of head 12.

Figure 8:
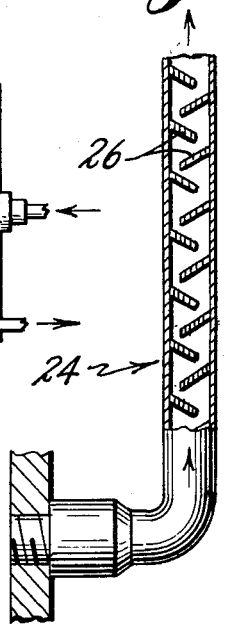
FIG. 8 is an elevational view, partially in section, illustrating the baffle plates and crankcase connection of the vent for prevention of back pressure build-up and oil loss.

Back pressure within crankcase 20 is prevented by a vent 24 which, as illustrated in FIG. 8, also is provided with baffles 26 for preventing loss of oil.

Figure 9:
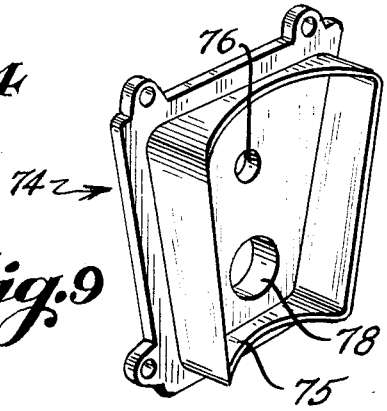
FIG. 9 is an isomeric view, similar to that of FIG. 4, of a transfer port blocking plate providing a connection for a fuel nozzle.
Figure 6:
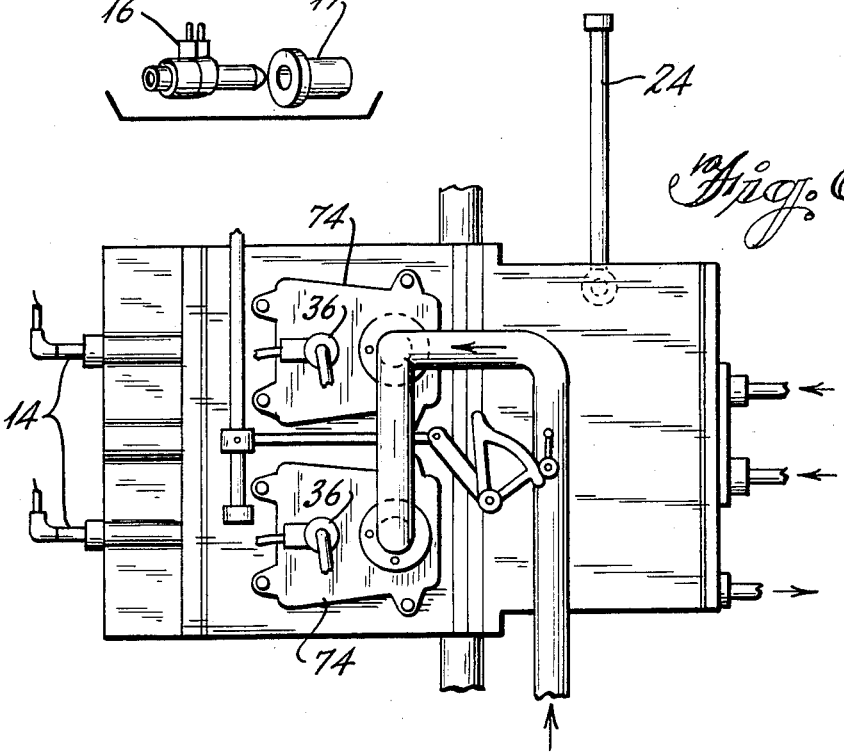
FIGS. 6 and 7 are similar to FIGS. 3 and 1, respectively, but with the fuel injection nozzles mounted for sidewall supply of fuel.
Figure 7:
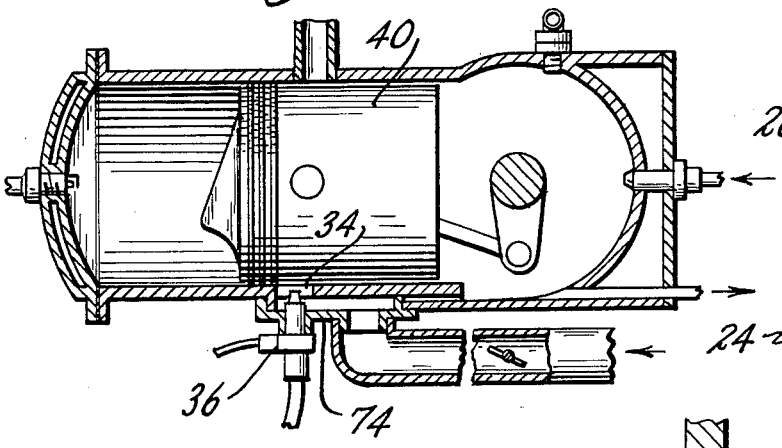

An alternate embodiment of the instant invention is illustrated in FIGS. 6, 7 and 9, in which the transfer port blocking plate 74 is provided with a fuel injection nozzle mounting orifice 76 in addition to air inlet 78 and transfer port blocking baffle 75. Such an arrangement is thought to provide for better mixing of the air and fuel by entraining the injected fuel in the pressurized air supplied by air blower 60. In this regard, it is contemplated that nozzle 36 also may be other than an injection nozzle, such that fuel may be carried into the combustion chamber by the pressurized air via a venturi effect mechanism. As may be appreciated by referring to FIG. 7, nozzle 36 is arranged for protection from direct combustion by piston 40 covering intake port 34 prior to ignition of the combustible mixture. With such protection, the lifetime of the fuel nozzle is increased by at least two and a half times.

Figure 14:
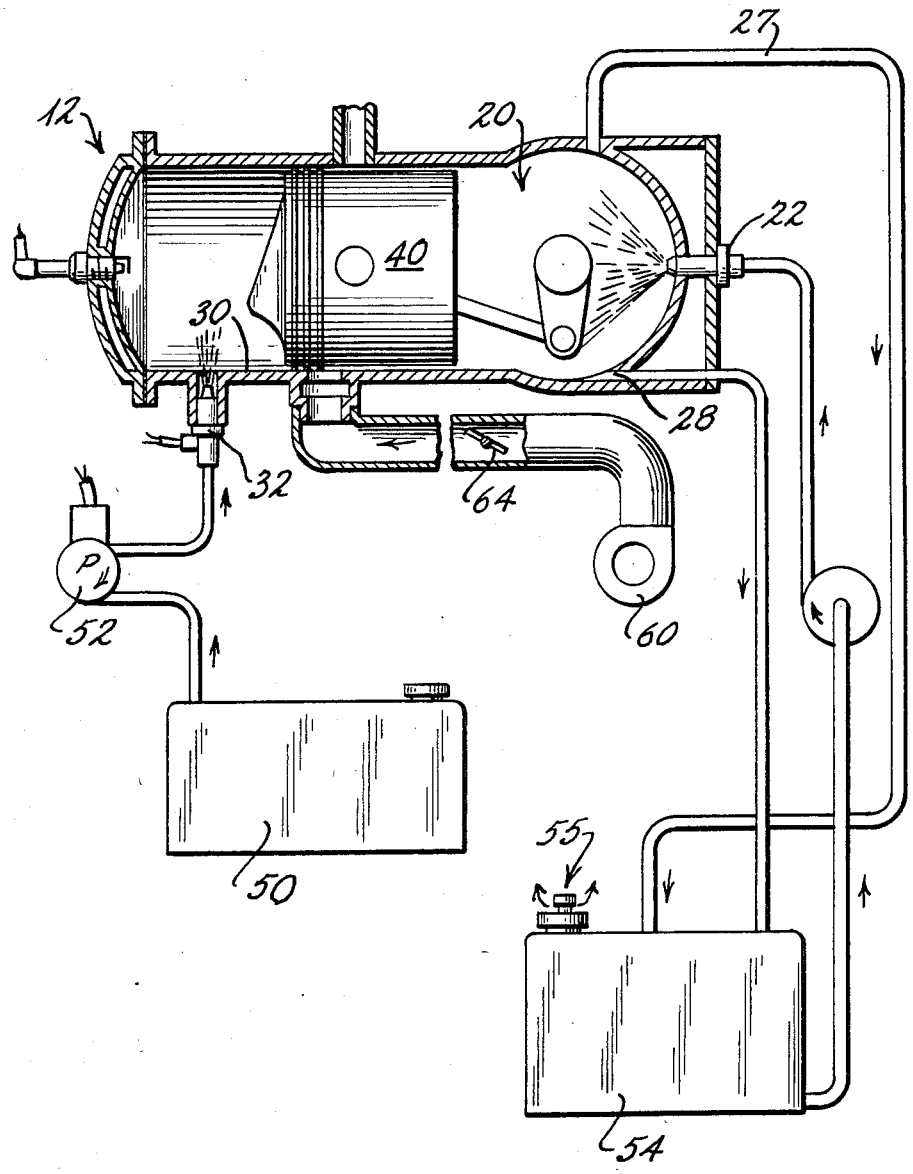
FIG. 14 is a view, similar to that of FIG. 1, illustrating an original casting of the improved engine with the injection nozzle mounted in the sidewall for direct communication with the combustion chamber.

FIG. 14 illustrates a cylinder in accordance with still another embodiment of the instant invention. In this embodiment, fuel injection nozzle 32 is arranged in the sidewall 30 of the cylinder somewhat closer to head 12 than that of FIG. 7. Nozzle 32 is also protected from the immediate combustion by piston 40. Instead of the earlier described vent 24, this embodiment incorporates a return line 27 from crankcase 20 to the top of oil reservoir 54 and across the unfilled top portion thereof to self venting cap 55. It is contemplated that vent cap 55 may be of the type having a ball or other check valve therein so as to prevent loss of oil from reservoir 54 upon inversion thereof, while providing normal venting action otherwise.

Plates 70 and 74 of FIGS. 4 and 9, respectively, readily replace existing transfer port covers in standard two-stroke engines, thus providing for an easy retrofit thereof.

The instant invention combines the simplicity and lightweight power of a two-cycle engine with the fuel economy equal to that of a four-cycle engine. There are only three major moving internal parts, namely, the crankshaft with main bearings, the piston with wrist pin bearing, and the rod with rod bearing; no additional internal moving parts are required. All other parts are external and easily accessible for repair or replacement such that the engine does not need to be torn down.

From a manufacturing point of view, the cost of any casting modification is offset by the elimination of the need for carburetors, reed valves and the ports for transfer of the fuel/oil from the crankcase to the intake ports.

By use of the invention, fuel consumption is improved. In particular, standard outboard boat engines waste approximately 33% of the combustible mixture via drains in the crankcase for dumping excess fuel therefrom. By the instant invention, such drains have been enlarged and used for returning the lubricating oil to the oil reservoir.

Still further, the instant invention does not necessitate lowering of compression as in other types of injected engines and, by using points or an electronic eye on a spark advance plate, fuel can be metered from idle speed to wide open throttle by varying the injector nozzle from open to closed as the engine load requires. Since metering of the fuel is done electrically at the injector nozzle itself, the need for complicated gate valves or injector pumps is eliminated. Still further, injecting the oil into the crankcase with a cone shaped spray in order to impinge upon all moving parts therein allows the engine to be tilted at various angles while still providing excellent lubrication.

Figure 10:
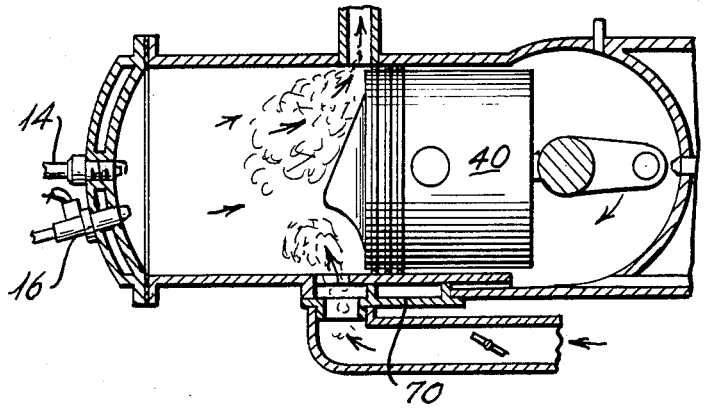
FIGS. 10–13 are cross-sectional views illustrating operation of the two-cycle engine of the instant invention.
Figure 11:
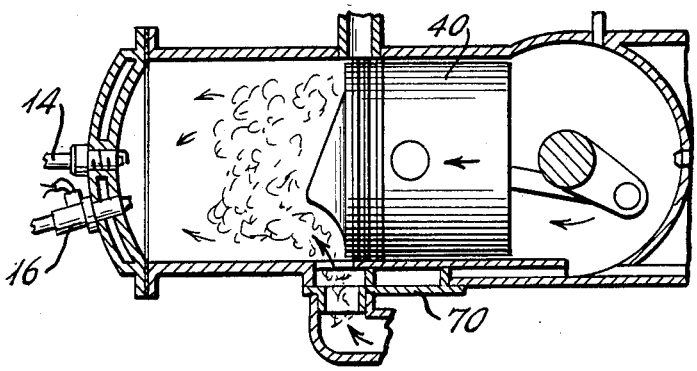
Figure 12:
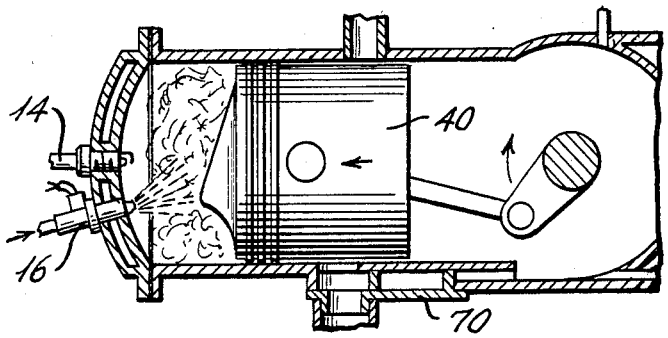
Figure 13:
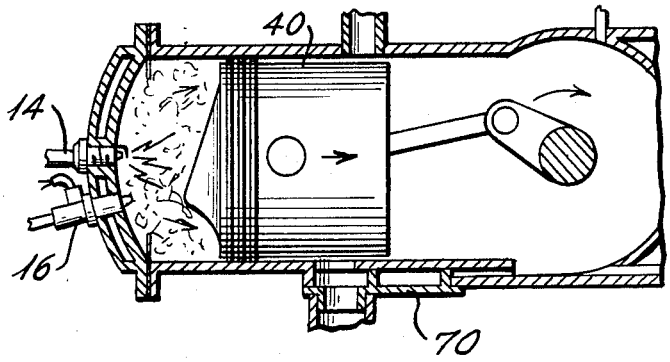

Operation of one embodiment of the invention may be understood by referring to FIGS. 10–13, in which FIG. 10 illustrates the piston 40 moving toward the crankcase during the power stroke such that air from blower 60 will exhaust the spent gases from the exhaust port 38 upon piston 40 uncovering ports 34 and 38. In FIG. 11, exhaust port 38 has been blocked by piston 40 and air enters the combustion chamber via port 34 along with fuel from fuel injection nozzle 16. In FIG. 12, it may be seen that air inlet port 34 is also blocked and compression is increased until ignition thereof via sparkplug 14, as may be seen in FIG. 13.

For the embodiment using sidewall injection as in FIG. 7, the only physical modifications of the cylinder are: replacement of the transfer port cover with a special plate 70, and replacement of the reed valve assemblies and carburetor by oil injection nozzles.

A prototype of one embodiment of this improved two-cycle engine incorporated: No. 3 Volkswagon fuel injectors with a modified gasket to seal the openings through the water jacket of the engine; a VITON tip rotary impeller, electric drive 12 V oil pump, maufactured by Sherwood Brass, recirculating at 4 gals. per minute with feed and return lines having diameters greater than or equal to $\frac{1}{4}''$; and a standard 1200 rpm, 6 cfm continuous pressure air blower. The cylinder head may be ceramic or cast iron, and an electric fuel pump that produces 90 psi is sufficient, since the fuel is loaded into the combustion chamber at the lower end of the compression stroke.

It will thus be seen that the objects set forth above, among those made apparent from the preceding description, are efficiently attained and, since certain changes may be made in carrying out the above method and in the construction set forth without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. In a two cycle, spark ignition boat engine with a cylinder having a combustion chamber defined by a head and sidewall of said cylinder in conjunction with a piston reciprocating within said cylinder on combustion and return strokes via connection with a piston rod and crankshaft arrangement located within a crankcase, said crankcase isolated at all times from said combustion chamber; intake and exhaust means, communicating with said combustion chamber, for providing a combustible mixture in said chamber and for exhausting spent gases of combustion from said chamber, respectively; and a spark plug communicating with said chamber in order to ignite said mixture according to timing of a spark advance mechanism; said piston separating said combustion chamber from said crankcase, the improvement comprising:

means for providing fuel and air into said combustion chamber to provide said combustible mixture therein during a compression stroke;

means located in a lowermost portion of said crankcase for continuously injecting oil into said crankcase and for continuously draining oil from said crankcase in order to constantly impinge upon and lubricate parts therein and to cool said parts by heat absorption, said oil injecting means providing a generally cone-shaped spray in order to impinge oil on all moving parts within said crankcase and to facilitate operation of said engine while tilted; and means for venting said crankcase in order to prevent a buildup of pressure therein during said return stroke, said venting means comprising a tube communicating said crankcase with atmosphere, said tube having interior baffles in order to prevent passage of oil therethrough from said crankcase with said engine tilted; and a plenum attached to an outside of said sidewall and communicating with an intake port of said intake means and isolated at all times from communication with said crankcase;

a fuel injection nozzle mounted in said plenum so as to inject fuel into said intake port according to said timing, whereby said nozzle is protected from said combustion by said piston covering said intake port prior to combustion;

an air supply conduit communicating said plenum with a continuous air blower; and valve means for varying a supply of air to said plenum from said continuous air blower according to said timing.

2. An improvement as in claim 1, wherein:

said intake and exhaust means respectively comprise intake and exhaust ports through said cylinder sidewall, said exhaust port being located farther from said cylinder head than said intake port, such that said piston closes said exhaust port prior to closing said intake port during said compression stroke in order to minimize losses of said combustible mixture.

3. An improvement as in claim 1, and wherein said oil injecting means comprises:

a nozzle generally centered upon a longitudinal axis of said cylinder to effect said generally cone-shaped spray of oil.

4. In a two cycle, spark ignition engine with a cylinder having a combustion chamber defined by a head and sidewall of said cylinder in conjunction with a piston reciprocating within said cylinder on combustion and return strokes via connection with a piston rod and crankshaft arrangement located within a crankcase, said crankcase isolated at all times from said combustion chamber; intake and exhaust means, communicating with said combustion chamber, for providing a combustible mixture in said chamber and for exhausting spent gases of combustion from said chamber, respectively; and a spark plug communicating with said chamber in order to ignite said mixture according to timing of a spark advance mechanism; said piston separating said combustion chamber from said crankcase, the improvement comprising:

means for providing fuel and air into said combustion chamber to provide said combustible mixture therein during a compression stroke;

means for pumping oil from a reservoir to a means located in a lowermost portion of said crankcase for continuously injecting oil into said crankcase in a generally cone-shaped spray and means for continuously draining oil from said crankcase back into said reservoir in order to constantly impinge upon and lubricate parts in said crankcase and to cool said parts by heat absorption hile circulating said oil and to facilitate operation of said engine while tilted; and means for venting said crankcase in order to prevent a pressure buildup therein during said return stroke, said venting means comprising a tube communicating said crankcase with atmosphere, said tube communicating with said atmosphere via an unfilled portion of said reservoir and a venting cap for said reservoir and a plenum attached to an outside of said sidewall and communicating with an intake port of said intake means and isolated at all times from communication with said crankcase;

a fuel injection nozzle mounted in said plenum so as to inject fuel into said intake port according to said timing, whereby said nozzle is protected from said combustion by said piston covering said intake port prior to combustion;

an air supply conduit communicating said plenum with a continuous air blower; and valve means for varying a supply of air to said plenum from said continuous air blower according to said timing.

5. A retrofit kit for improving the efficiency of a two cycle, spark ignition engine having a cylinder and a combustion chamber defined by a head and sidewall of said cylinder in conjunction with a piston reciprocating within said cylinder on combustion and return strokes via connection with a piston rod and crankshaft arrangement located within a crankcase; intake and exhaust means, communicating with said combustion chamber, for providing a combustible mixture in said chamber and for exhausting spent gases of combustion from said chamber, respectively; and a spark plug communicating with said chamber in order to ignite said mixture according to timing of a spark advance mechanism; said piston separating said combustion chamber from said crankcase and opening and closing a fuel transfer path around said piston according to positions of said piston during said reciprocating in order that a fuel-air mixture is transferable from said crankcase to said combustion chamber, said fuel-air mixture being supplied to said crankcase from a carburetor via a valve assembly, said kit comprising:

means for injecting fuel directly into said combustion chamber to provide said combustible mixture therein during a compression stroke;

nozzle assembly means for continuously injecting oil into said crankcase and for continuously draining oil from said crankcase in order to constantly impinge upon and lubricate parts therein and to cool said parts by heat absorption, said nozzle assembly means replacing said carburetor and valve assembly during retrofitting of said engine with said kit;

means for venting said crankcase in order to prevent a buildup of pressure therein during said return stroke, said venting means comprising a tube communicating said crankcase with the atmosphere; and plate means for blocking said fuel transfer path and for providing an air supply port to said combustion chamber from a blower.

* * * * *